US007239821B2

(12) United States Patent
Matsusaka et al.

(10) Patent No.: US 7,239,821 B2
(45) Date of Patent: Jul. 3, 2007

(54) IMAGE FORMING APPARATUS INCLUDING A HEATING UNIT

(75) Inventors: Susumu Matsusaka, Tokyo (JP); Kazuhito Kishi, Tokyo (JP); Yasuhisa Kato, Tokyo (JP); Akiyasu Amita, Tokyo (JP); Masami Okamoto, Tokyo (JP); Yasutada Tsukioka, Tokyo (JP); Hiromasa Takagi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 147 days.

(21) Appl. No.: 11/049,717

(22) Filed: Feb. 4, 2005

(65) Prior Publication Data

US 2005/0175368 A1 Aug. 11, 2005

(30) Foreign Application Priority Data

Feb. 5, 2004 (JP) ..... 2004-029259

(51) Int. Cl.
*G03G 15/20* (2006.01)

(52) U.S. Cl. ..... 399/69

(58) Field of Classification Search ..... 399/69
See application file for complete search history.

(56) References Cited

U.S. PATENT DOCUMENTS 4,843,214 A 6/1989 Higashi et al.
5,481,350 A 1/1996 Yasui et al.
5,854,465 A 12/1998 Kishi et al.
6,542,705 B2 4/2003 Fujita et al.
6,813,464 B2 11/2004 Amita et al.
2002/0043523 A1* 4/2002 Fujita et al. ..... 219/216
2004/0022552 A1 2/2004 Yura et al.
2004/0149740 A1 8/2004 Kishi et al.
2004/0179875 A1 9/2004 Iwata et al.
2004/0202490 A1 10/2004 Okamoto
2004/0245241 A1 12/2004 Kishi et al.
2004/0247334 A1 12/2004 Kishi et al.

FOREIGN PATENT DOCUMENTS

EP 1 542 085 A1 6/2005

(Continued)

OTHER PUBLICATIONS

U.S. Appl. No. 11/283,828, filed Nov. 22, 2005, Okamoto.

(Continued)

*Primary Examiner*—David M. Gray
*Assistant Examiner*—Bryan Ready
(74) *Attorney, Agent, or Firm*—Oblon, Spivak, McClelland, Maier & Neustadt, P.C.

(57) ABSTRACT

Power is supplied from a capacitor of an auxiliary power source to a secondary heating element of a heating unit, thereby preventing temperature drop of a fixing roller at the time of continuous paper delivery. An allowable range for starting discharge from the capacitor is set to, for example, 30 to 40 volts. A discharge time in which the voltage of the capacitor reduces to a termination value, such as 20 volts, is longer than a time necessary for a reading unit to read a maximum number (for example, 100 sheets) of documents that can be read at one time.

14 Claims, 4 Drawing Sheets

FOREIGN PATENT DOCUMENTS

| | | |
|---|---|---|
| JP | 10-10913 | 1/1998 |
| JP | 10-282821 | 10/1998 |
| JP | 11-133794 | 5/1999 |
| JP | 2002-184554 | 6/2002 |
| JP | 2002-268446 | 9/2002 |

OTHER PUBLICATIONS

U.S. Appl. No. 11/405,448, filed Apr. 18, 2006, Kishi et al.
U.S. Appl. No. 11/554,944, filed Oct. 31, 2006, Yano et al.
U.S. Appl. No. 11/522,324, filed Sep. 18, 2006, Semma et al.
U.S. Appl. No. 11/609,467, filed Dec. 12, 2006, Kishi et al.

* cited by examiner

IMAGE FORMING APPARATUS INCLUDING A HEATING UNIT

CROSS-REFERENCE TO RELATED APPLICATIONS

The present document incorporates by reference the entire contents of Japanese priority document, 2004-029259 filed in Japan on Feb. 5, 2004.

BACKGROUND OF THE INVENTION

1). Field of the Invention

The present invention relates to an image forming apparatus (such as copy machine, printer, and facsimile) that has a minimum number of condensers (such as capacitor) to prevent temperature drop of a fixing device (such as fixing roller) due to continuous paper delivery.

2). Description of the Related Art

An image forming apparatus, such as copy machine that forms an image on a recording medium such as ordinary paper and over head projector (OHP), frequently employs the electrophotographic system in view of high-speed, image quality, cost, and the like. The electrophotographic system is a method in which a toner image is formed on a recording medium, and the formed toner image is fixed on the recording medium by heat and pressure. As to a fixing system, a heat roller system is employed most frequently at present in view of safety and the like. In the heat roller system, a mutually pressed portion referred to as a nip portion is formed by pressing a heat roller heated by a heating member such as halogen heater against a pressure roller arranged opposite to the heat roller, and a recording medium on which a toner image has been transferred is heated and pressed while passing through this nip portion, thereby fixing the toner onto the recording medium.

In recent years, an environmental issue has become important, which leads to energy saving in the image forming apparatus such as copy machine and printer. When energy saving of these image forming apparatuses is taken into consideration, what cannot be ignored is power saving of a fixing device that fixes toner to a recording medium. More power saving is demanded by reducing energy consumption during standby (when the apparatus is not in use), in concrete terms, reducing to zero.

However, when the energy consumption is made zero during standby, a long heating time, for example, a few minutes to over ten minutes is needed to raise the temperature to a usable temperature of approximately 180 degrees C. because a metal roller made of, for example, iron or aluminum is mainly used for the heat roller of the fixing device, and therefore the thermal capacity is large. Such a waiting time worsens the usability of the apparatus for a user. Accordingly, a heating system in which power consumption is as small as possible, while startup is fast from a standby state has been desired.

To shorten the time taken to raise the temperature of the heat roller, it is obvious that making supplied energy per hour, that is, rated power large is good. In practice, many image forming apparatus called a high-speed machine of which printing speed is fast are operated with 200 volts for their power voltage. However, commercial power used in common offices in Japan is 100 volts and 15 amperes; therefore, special work is required for power-related facility at an installation site of the machine in order to deal with 200 volts. Adaptation to 200 volts is not regarded as a common resolution.

As long as commercial power of 100 volts and 15 amperes is used, maximum supplied energy is determined due to the power source even though the temperature of the heat roller is tried to be raised within a short time. Thus, in a conventional technology disclosed in Japanese Patent Application Laid-Open Publication No. H10-10913, temperature of a heat roller is constantly maintained slightly lower than a fixing temperature during standby, and the temperature is immediately raised to a usable temperature when the image forming apparatus is used. Therefore, a user does not have to be kept waiting until the temperature of the fixing roller is raised. This technology is commonly used for reduction of power consumption of the fixing device during standby of the image forming apparatus.

However, a certain amount of power must be supplied to the fixing device even when the fixing device is not in use. It is said that energy consumption during standby corresponds to about 70 to 80 percent of the whole energy consumption of devices constituting the image forming apparatus. Thus, extra energy is disadvantageously consumed, and energy saving is not sufficient. Further, the technology does not aim at increasing the maximum supplied power at the startup more than the power supplied from the main power source.

On the other hand, in a conventional technology disclosed in Japanese Patent Application Laid-Open Publication No. H10-282821, a secondary battery serving as an auxiliary power source is charged during standby of the fixing device, and power is supplied from a main power source and the secondary battery or a primary battery when the fixing device is started up, thereby the rise time is shortened. As the secondary battery, a lead-acid battery, a nickel-cadmium battery, or a nickel-hydrogen battery is generally used. The capacity of such a secondary battery is degraded and reduced when charge and discharge are repeated (i.e. memory effect). The life of such a secondary battery is shortened as power is discharged in a larger-current. Even for batteries that are said to have generally a long life, when discharge is carried out in a large current, the number of repetition of charge and discharge is approximately 500 to 1,000. If charge and discharge is repeated 20 times a day, the life of the battery runs out in about one month. Therefore, battery exchange is carried out more frequently, which makes a trouble and increases a running cost such as cost of batteries to be exchanged. Furthermore, lead-acid batteries use liquid sulfuric acid for electrolyte and so forth, and therefore, there is also an undesirable aspect that they are not suitable for office machines.

Still further, there are problems that not only is the load to the heating circuit built in the heat roller increased by an abrupt current change, inrush power, and the like but also noise is generated owing to flow of the inrush current to peripheral circuits when supply of large power is started and stopped. Accordingly, frequent turning on and off of power supply from an auxiliary power source with a large capacity is not desirable. Moreover, when a large amount of power is supplied at one time, the supply becomes excessive, which may lead to a possibility that the temperature of the heating circuit rises too high.

A device that uses a capacitor capable of charging and discharging an auxiliary power source, has a charger that charges the capacitor of the auxiliary power source with power supplied from a main power source, and a switching unit that switches between the charge of the auxiliary power source and the power supply from the auxiliary power source to a secondary heating element and adjusts electric energy supplied from the auxiliary power source to the secondary heating element has been proposed as a fixing device that can improve the above problems, enhance a power saving effect, reduce the noise caused by an inrush current and abrupt current change at the time of large power supply, shorten the rise time, and prevent the temperature from rising too high (see, for example, Japanese Patent Application Laid-Open Publication No. 2002-184554).

In other words, the objects to supply power of the capacitor are as follows: First, supply of the capacitor power at the time of startup of a copy machine and the like allows supplying power exceeding the amount that can be supplied from commercial power to the fixing device, thereby making it possible to shorten the rise time; Next, although there has been a problem that a thin fixing roller with a small thermal capacity cannot be used in a high-speed machine because a large amount of heat of the fixing roller is lost from the recording member, which makes the temperature of the fixing roller appreciably low, supply of the capacitor power at the time of temperature drop of the fixing device allows the temperature drop to be prevented and a thin roller to be used in a high-speed machine.

On adoption of a condenser such as capacitor described above, prevention of fixing failure is the highest priority. Therefore, in accordance with specifications of copy machines, the electrostatic capacity of the capacitor is set so that the temperature drop of the fixing roller does not occur regardless of how many sheets of paper can be continuously fed and regardless of the type of paper used. Further, the price of a capacitor is very high at present, and therefore, mounting of capacitors more than required gives rise to unnecessarily high cost of an image forming apparatus such as copy machine. Thus, the number of capacitor to be mounted is preferred to be minimally necessary. However, due to the above problems, determination of an optimum electrostatic capacity is difficult, resulting in that capacitors have been mounted more than required in conventional machines. Therefore, condensers such as capacitor have not been used efficiently so far.

SUMMARY OF THE INVENTION

It is an object of the present invention to at least solve the problems in the conventional technology.

An image forming apparatus according to an aspect of the present invention includes a condenser; a reading unit that reads images of a plurality of documents one-by-one; a heating unit that applies heat to an unfixed image that corresponds to the images read by the reading unit; and a power-controlling unit that causes the condenser to supply power to the heating unit when a voltage of the condenser is higher than a threshold. The threshold is determined so that the temperature of the heating unit can be kept at a predetermined temperature or higher for a predetermined time.

An image forming apparatus according to another aspect of the present invention includes a condenser; a reading unit that reads images of a plurality of documents one-by-one; a heating unit that applies heat to an unfixed image that corresponds to the images read by the reading unit; and a power-controlling unit that causes the condenser to supply power to the heating unit when a voltage of the condenser is higher than a threshold. The threshold is determined so that the condenser can keep supplying power to the heating unit for a predetermined time.

An image forming apparatus according to still another aspect of the present invention includes a condenser; a reading unit that reads images of a plurality of documents one-by-one; a heating unit that applies heat to an unfixed image that corresponds to the images read by the reading unit; and a power-controlling unit that causes the condenser to supply power to the heating unit when a voltage of the condenser is higher than a first threshold, and to stop supplying power to the heating unit when the voltage of the condenser is lower than a second threshold. A charge target voltage of the condenser, which is higher than the first threshold, is determined so that the temperature of the heating unit can be kept at a predetermined temperature or higher for a predetermined time.

An image forming apparatus according to still another aspect of the present invention includes a condenser; a reading unit that reads images of a plurality of documents one-by-one; a heating unit that applies heat to an unfixed image that corresponds to the images read by the reading unit; and a power-controlling unit that causes the condenser to supply power to the heating unit when a voltage of the condenser is higher than a first threshold, and to stop supplying power to the heating unit when the voltage of the condenser is lower than a second threshold. A charge target voltage of the condenser, which is higher than the first threshold, is determined so that the condenser can keep supplying power to the heating unit for a predetermined time.

The other objects, features, and advantages of the present invention are specifically set forth in or will become apparent from the following detailed description of the invention when read in conjunction with the accompanying drawings.

DETAILED DESCRIPTION

Exemplary embodiments of the present invention are explained below with reference to accompanying drawings.

Figure 1:
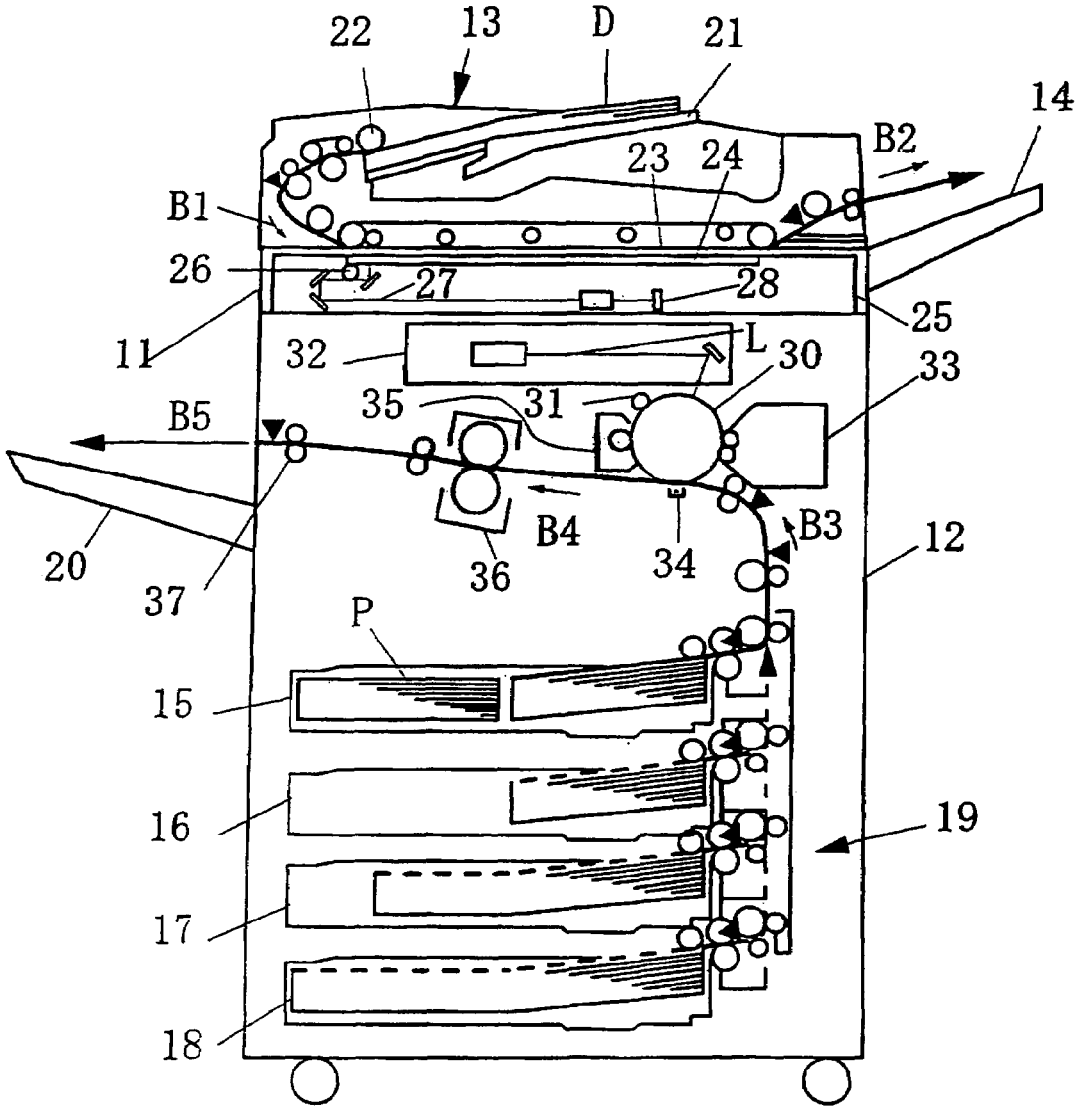
FIG. 1 is a cross sectional view of an image forming apparatus according to the present invention.

FIG. 1 is a cross sectional view of an image forming apparatus such as copy machine and printer of electrophotographic system according to the present invention. The image forming apparatus of the present embodiment is capable of feeding continuously, for example, 100 sheets of paper (75 copies per minute (CPM)). The image forming apparatus is composed of, in its main structure, a reading unit 11 that reads a document, an image forming unit 12 that forms an image, an automatic document feeder (ADF) 13, a paper delivery tray 14 that stacks documents sent out of the ADF 13, a paper feeder 19 provided with paper feeding cassettes 15 to 18, and a paper delivery tray 20 that stacks recording paper. For example, the maximum feeding capacity of paper that the ADF 13 can feed is 100 sheets of paper, and a reading time taken for the reading unit 11 to read 100 sheets of documents is 60 seconds.

The upper most sheet of a document D set on a document feeder table 21 of the ADF 13 is sent out in the direction shown by an arrow B1 by rotation of pick-up rollers 22 when an operation on an operating unit not shown, for example, pressing down a print key is executed. The sheet of the document D is delivered onto a contact glass 24 fixed to the reading unit 11 by the rotation of a conveyor belt 23 and stops thereon. An image on the document D placed on the contact glass 24 is read by a reading device 25 arranged between the image forming unit 12 and the contact glass 24. The reading device 25 includes a light source 26 that illuminates the document D on the contact glass 24, an optical mechanism 27 that forms a document image, an optoelectronic conversion element 28 composed of a charge-coupled device (CCD) that forms the document image, etc., and the like. After reading the image, the document D is delivered in the direction shown by an arrow B2 by the rotation of the conveyor belt 23 to be discharged onto the paper delivery tray 14. In this manner, sheets of the document D are delivered onto the contact glass 24 one by one, and the document images are read by the reading unit 11.

On the other hand, a photosensitive member 30 that serves as an image carrier is arranged inside the image forming unit 12. The photosensitive member 30 is rotatably driven clockwise in FIG. 1 and a charging device 31 charges its surface with a predetermined potential. Further, a laser light L that is light-modulated in accordance with image information read by the reading device 25 is irradiated from a writing unit 32, and the surface of the photosensitive member 30 charged is exposed to the laser light L, thereby forming an electrostatic latent image on the surface of the photosensitive member 30. When passing through a developing device 33, this electrostatic latent image is transferred to a recording medium P conveyed between the photosensitive member 30 and a transfer device 34 by the transfer device 34 arranged opposite to the developing device 33. The surface of the photosensitive member 30 is cleaned by a cleaning device 35 after a toner image is transferred.

The plurality of paper feeding cassettes 15 to 18 arranged in the lower portion of the image forming unit 12 house recording media P such as paper. A recording medium P is sent out of any one of the paper feeding cassettes 15 to 18 in the direction shown by an arrow B3, the toner image formed on the surface of the photosensitive member 30 as described above is transferred on the surface of the recording medium P. Next, the recording medium P is allowed to pass a fixing device 36 in the image forming unit 12 in the direction shown by an arrow B4, and the toner image transferred on the surface of the recording medium P is fixed by the action of heat and pressure. The recording medium P having passed through the fixing device 36 is delivered by pairs of delivery rollers 37, discharged in the direction shown by an arrow B5 to the paper delivery tray 20, and stacked.

Figure 2:
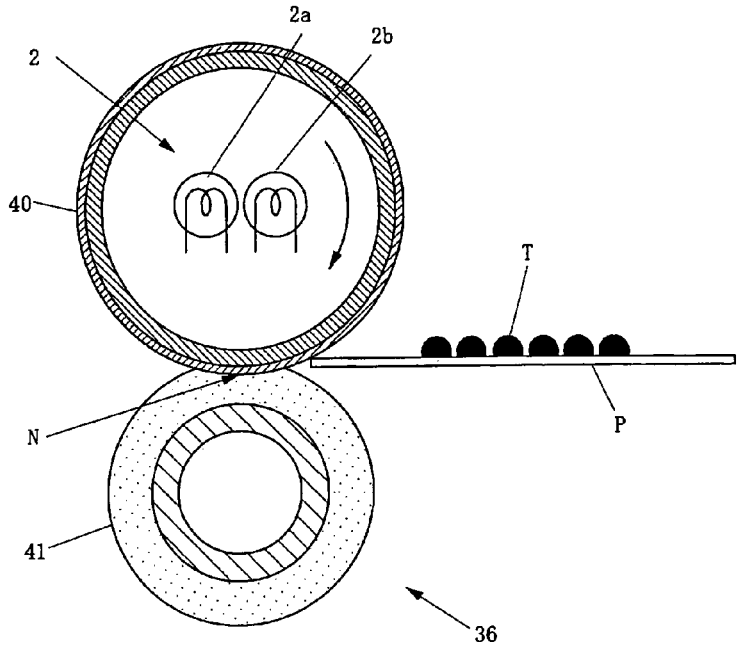
FIG. 2 is a cross sectional view of a fixing device in the image forming apparatus.
Figure 3:
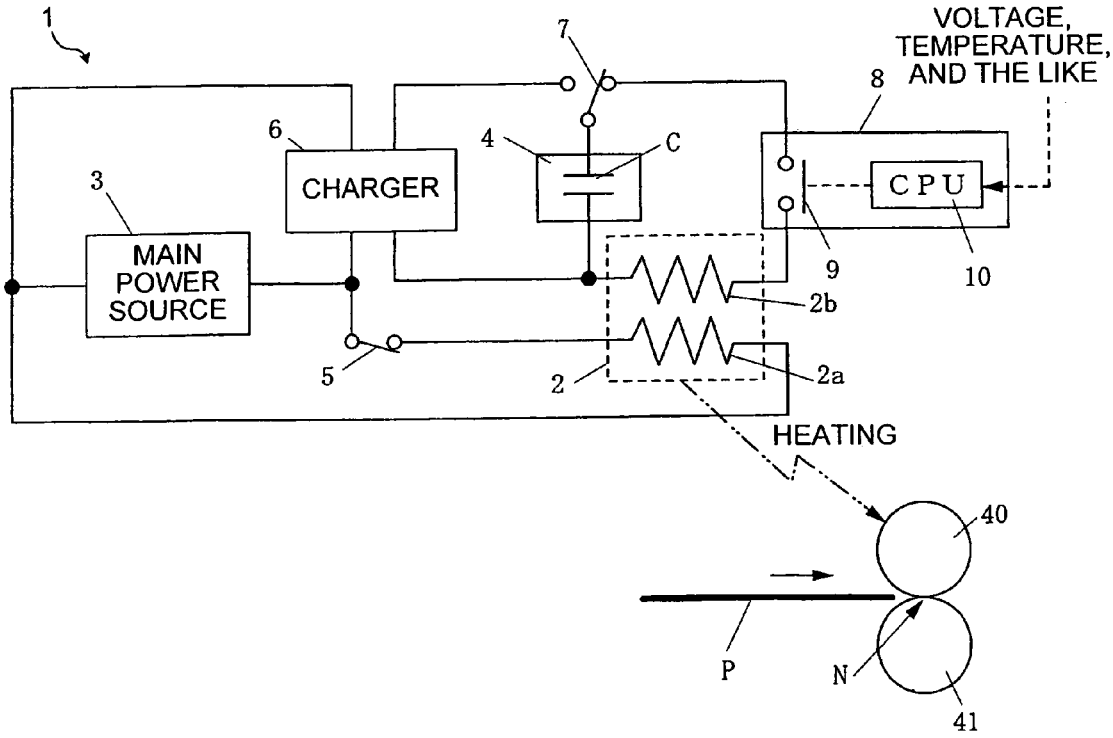
FIG. 3 is a schematic of a circuit structure of a heating system in the image forming apparatus.

FIG. 2 is a cross sectional view of one example of the fixing device 36 that fixes a toner image transferred on a recording medium P to the recording medium by heating and pressing. FIG. 3 is a schematic of a circuit structure of one example of a heating system 1 provided to the fixing device 36.

The fixing device 36 of FIG. 2 has a fixing roller 40 and a pressure roller 41. For example, in an image forming apparatus with 75 cpm, a roller made of aluminum with an outer diameter ϕ of 40 millimeters and a thickness t of 0.7 millimeters is used for the fixing roller 40. This is because not only can the temperature of the fixing roller rise high enough to allow the fixing roller to become capable of fixation within 30 seconds with this thickness but also a load needed to form a nip width N required for fixation cannot destroy the fixing roller. In a machine with 75 cpm, a thick roller with a thickness t of ca. 5.0 to 10 millimeters has been conventionally used when an auxiliary power source is not used. However, a combination of a thin roller and an auxiliary power source makes it possible to shorten the rise time significantly. It is desired that the outer-most layer of the fixing roller is formed of a release layer made of perfluoroalkoxy (PFA), polytetrafluoroethylene (PTFE), or the like. The fixing roller 40 accommodates a heating unit 2 including, for example, a primary heating element 2*a* composed of a halogen heater and a secondary heating element 2*b*, and a nip portion N is formed by the fixing roller 40 and the pressure roller 41, where the recording medium P applied With toner T is heated and pressed when it is allowed to pass through the nip portion N.

The heating system 1 includes the heating unit 2, a main power source 3, an auxiliary power source 4, a main switch 5, a charger 6, a switch 7, and a controlling unit 8. Although the heating unit 2 composed of the primary heating element 2*a* and the secondary heating element 2*b* is illustrated to be arranged outside the fixing roller 40 in FIG. 3, this is only for the convenience of illustration, and both heating elements 2*a* and 2*b* are arranged inside the fixing roller 40.

The heating unit 2 includes the primary heating element 2*a* heated by power supplied from the main power source 3 and the secondary heating element 2*b* heated by power supplied from the auxiliary power source 4, and heats the fixing roller 40 that serves as an element to be heated. The main power source 3, of which detailed illustration is omitted, receives power supply from commercial power in the image forming apparatus arranged with the heating system 1. The main power source 3 has a function that adjusts power supplied from, for example, a wall outlet to a voltage corresponding to the heating unit 2, and so forth. However, the function is well known, and therefore, its detailed illustration and explanation are omitted.

The auxiliary power source 4 has a capacitor C capable of charge and discharge. The capacitor C is preferably constructed in a module structure in which, for example, 15 to 40 cells each having capacitance of ca. 400 to 1,000 farads at rated 2.5 volts are connected in series, and a predetermined rated voltage and capacity are provided, and so forth. Further, for the use of the capacitor to prevent a fixing temperature from dropping during continuous paper delivery, for example, a heater of ca. rated 300 to 600 watts is used, and therefore, a capacitor in which 18 to 22 cells each having 500 to 700 farads are connected in series is suitable. This capacity is suitable because not only is the capacitor provided with a capacity sufficient to supply power for about one to two minutes but also its capacity is at a level that when all stored power is supplied from a high temperature state due to runaway of the control mechanism, the power is decreased as the voltage decreases, thereby reducing hazard of ignition. Furthermore, another reason that the above capacitor is suitable lies in that the voltage is approximately 50 volts, which is free from danger of electric shock. Still further, for the use of the capacitor to supply power at the time of startup, a capacitor in which 36 to 44 cells each having 500 to 700 farads are connected in series is suitable because, for example, a heater of rated 800 to 1,000 watts is connected in parallel to an auxiliary power source to supply a total power of ca. 1,600 to 2,000 watts. This is because the capacitor not only is provided with a capacity and a voltage that are capable of supplying power sufficient for power supply for about 10 seconds but also has a capacity that can prevent the fixing temperature from dropping by using only one heater even when shifted to continuous paper delivery. In an actual operation state, a target voltage to be charged is set to a voltage lower than the rated voltage. This is because reliability of the capacitor can be enhanced in consideration of variations in the voltage circuit, durability of the capacitor cells, and the like. A module structure in which cells with a lower electrostatic capacitance of ca. 100 farads are connected in parallel may be used; however, it is desirable that all cells are connected in series because not only can the number of electronic circuits required for one cell be reduced but also detection is easy when malfunction occurs in the cells.

The structure described above is employed because capacitors, such as an electric double layer capacitor, have an excellent characteristic as any chemical reaction is not accompanied. This is the difference between the capacitors and secondary batteries. As described above, an auxiliary power source that uses a common nickel-cadmium battery as a secondary battery requires a long time ranging from several tens of minutes to several hours to recharge even by boosting charge. However, boosting charge within about several minutes is possible for the auxiliary power source 4 that uses the capacitor. When a standby state and a heating state are repeated within the same time, power can be reliably supplied from the auxiliary power source 4 by the use of the auxiliary power source 4 that uses the capacitor when heating begins, thereby raising the temperature of the heating unit 2 to the predetermined temperature within a short time. Further, the number of permissible repetition of charge/discharge for a nickel-cadmium battery is about 500 to 1,000. Therefore, the life of the battery is short as an auxiliary power source for heating, which gives rise to problems of labor of exchanging batteries and high cost. On the other hand, with the auxiliary power source 4 that uses the electric double layer capacitor, the number of permissible repetition of charge/discharge is more than 1,000,000, deterioration of the auxiliary power source 4 due to the repetition of charge/discharge is little, and further, it is unnecessary to exchange and refill liquid as in the case of a lead-acid battery. Accordingly, little maintenance is required and long stable use is possible.

The electric double layer capacitor does not have any dielectric and takes advantage of absorption/desorption reaction (charge and discharge) of an ion absorption layer of the electric double layer generated at an interface between a solid electrode and a solution where electric charge of ions or solvent molecules concentrate, and the electric double layer capacitor is sturdy against repetitious charge/discharge and has a long life, and therefore maintenance-free. Moreover, the electric double layer capacitor is friendly to the environment, requires a shorter charging time compared to that of other batteries, and has high charge/discharge efficiency and excellent characteristics that it is easy to know the amount of residual power by detecting the voltage, and so forth. In recent years, a capacitor with a large capacity in which capacitance is several tens of thousand farads and its energy density is several tens wh/kg has been developed, whereby making the capacity further larger is under way.

The main switch 5 turns on/off power supplied from the main power source 3 to the primary heating element 2*a*. The charger 6 charges the capacitor C of the auxiliary power source 4 with power supplied from the main power source 3. The switch 7 switches between charging the auxiliary power source 4 and supplying power from the auxiliary power source 4 to the secondary heating element 2*b*.

The controlling unit 8 has a switch 9 and a central processing unit (CPU) 10, and controls turning on/off of power to be supplied from the auxiliary power source 4 to the secondary heating element 2*b*, and so forth under the preset conditions described later. The structure of the controlling unit 8 shown in FIG. 3 is a mere example to represent only a portion which controls the heating unit 2, and therefore, various structures in which a unit that controls a whole image forming apparatus also serves as the controlling unit 8 and so forth can be employed. Further, the connection mode to control the auxiliary power source 4, and the like are not limited to the illustrated example. Various modes of structures in which, for example, the switch 7 may play a role of controlling on/off, and so forth can be employed.

A basic operation of the heating system 1 is explained next. During standby, the switch 7 switches the connection of the charger 6 to the auxiliary power source 4, and the capacitor C of the auxiliary power source 4 is charged. To heat the heating unit 2 by the heating system 1 in this state, the main switch 5 is turned on, and power is supplied from the main power source 3 to the primary heating element 2*a*. At the same time, the switch 7 switches to supplying power from the auxiliary power source 4 to the secondary heating element 2*b*. Thus, when the heating unit 2 begins to be heated, a large amount of power is supplied to the heating unit 2 from both the main power source 3 and the auxiliary power source 4. Therefore, the temperature of the heating unit 2 can be raised to the predetermined temperature within a short time.

When a designated time set in advance has passed since the heating unit 2 starts to generate heat with the secondary heating element 2*b*, which is supplied power from the auxiliary power source 4, the controlling unit 8 shuts down the power supplied from the auxiliary power source 4 to the secondary heating element 2*b* to prevent the heating unit 2 from being overheated and to keep a predetermined temperature. The power supplied from the auxiliary power source 4 to the secondary heating element 2*b* is decreased as time passes after the power supply has started. Corresponding to the decreased amount of this power supply, a time to stop the power supply from the auxiliary power source 4 to the secondary heating element 2*b* is set. In other words, the power supply from the auxiliary power source 4 to the secondary heating element 2*b* is stopped when the, power supply is decreased to a certain degree. As a result, deterioration of each part of the peripheral circuits and electromagnetic noise generated at the time of stopping large power supply can be prevented.

The recording medium P, on which the toner image T has been transferred, sent to the fixing device 36 is delivered between the fixing roller 40 and the pressure roller 41, and the toner T is heated and fused by the fixing roller heated to the predetermined temperature, and fixed on the recording medium P as a toner image. To fix a toner image, power is supplied from the main power source 3 and the auxiliary power source 4 to the primary heating element 2*a* and the secondary heating element 2*b* that are included in the heating unit 2 of the fixing roller 40, thereby raising the temperature of the fixing roller 40. In addition, by controlling on/off of the power supplied from the auxiliary power source 4, the temperature of the fixing roller 40 is prevented from being excessively high, and the fixing temperature is kept constant or at a desired temperature, or by controlling the power supply such that the temperature shows a required temperature change, the toner T is stably heated and fused, whereby the toner image T with high quality is fixed on the recording medium P. Further, the temperature of the fixing roller 40 is raised by supplying power from the main power source 3 and the auxiliary power source 4 to the primary heating element 2*a* and the secondary heating element 2*b* of the heating unit 2 built in the fixing roller 40. Therefore, the surface temperature of the fixing roller 40 can be quickly raised to the predetermined fixing temperature.

Figure 4:
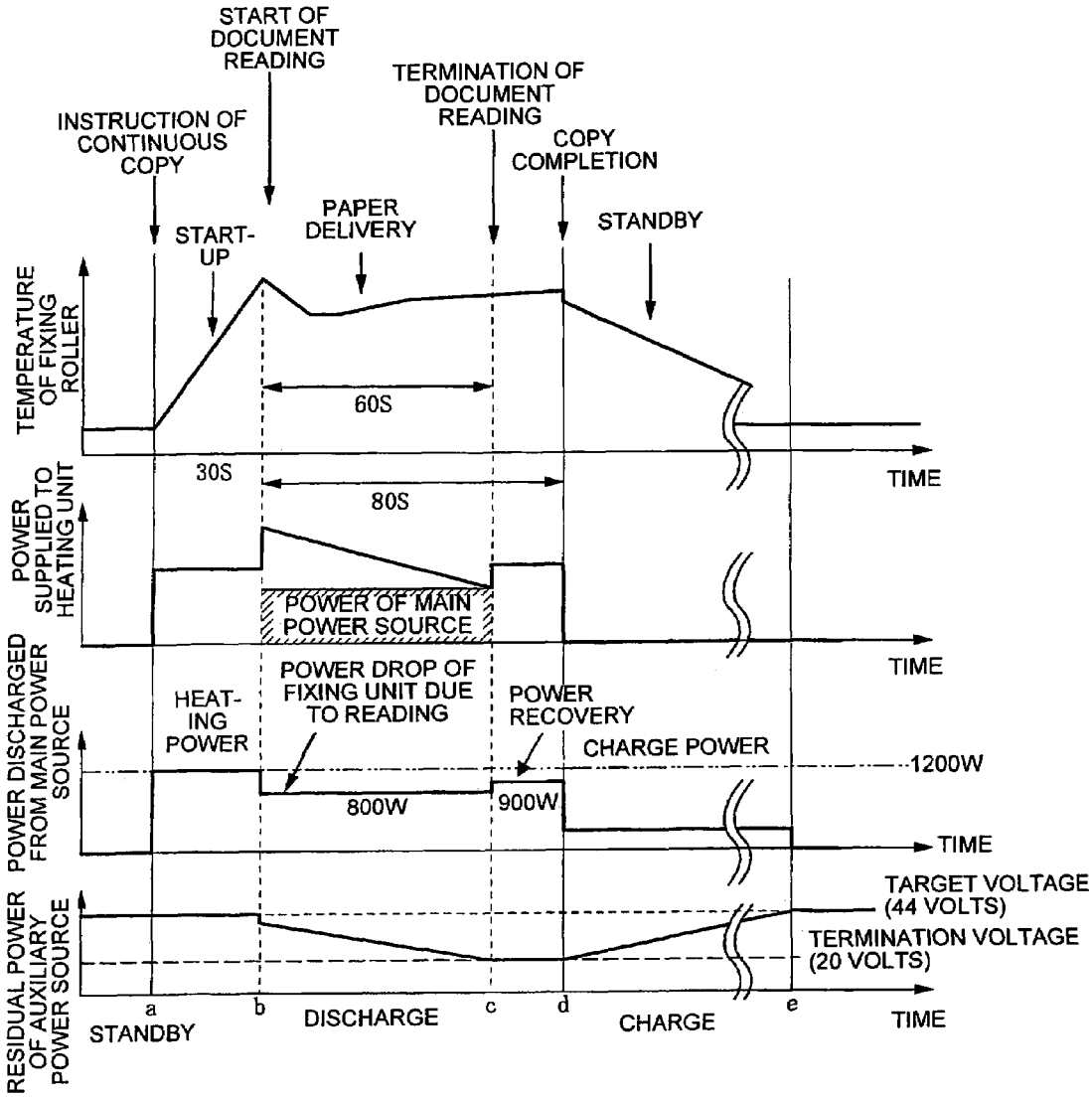
FIG. 4 is a schematic for explaining changes of temperature of a fixing roller, power supplied to a heating unit, discharge power of a main power source, and residual power of an auxiliary power source.

FIG. 4 is a schematic for explaining changes of the temperature of the fixing roller 40, the power supply to the heating unit 2, the discharge power of the main power source 3, and the residual power of the auxiliary power source 4 of the image forming apparatus constructed as described above during operations. In the present embodiment, the number of continuous paper feeding is 100 (75 cpm), the number of ADF maximum mounted paper is 100, the rated voltage of the capacitor C is 45 volts and the target voltage to be charged to the capacitor C is 44 volts (the capacitor C is not fully charged to prevent its deterioration), the allowable range for starting discharge from the capacitor C is 30 to 44 volts, and the termination voltage of discharge is 20 volts (a discharge time from the target voltage of 44 volts to the termination voltage of 20 volts is, for example, 90 seconds). When the voltage of the capacitor C is less than 20 volts, the heat from the secondary heating element 2*b* of the heating unit 2 becomes small; therefore, a voltage of 20 volts is set as a termination voltage.

The temperature of the fixing roller 40 in a state where power is not consumed so much during standby rises in concert with the beginning of the startup action (time point a) according to the continuous copy instruction, drops due to a heat movement to the recording medium P by the beginning of the paper feeding action (time point b), and then keeps rising slightly until termination of document reading (time point c) and completion of copying (time point d). When the action returns to standby, the temperature keeps dropping. The time between the time points a and b is, for example, 30 seconds, the time between the time points b and c is, for example 60 seconds and between b and d is, for example, 80 seconds.

The power supply to the heating unit 2 in this action varies from a state of no-power supply during standby (until the time point a) to power supply by the main power source 3 at the time of startup (between the time points a and b), power supply by the main power source 3 and the auxiliary power source 4 during paper delivery action (between the time points b and c), power supply by the main power source 3 after termination of document reading (between the time points c and d), and again to a state of no-power supply during standby (after the time point d). The power supply by the main power source 3 and the auxiliary power source 4 (between the time points b and c) is carried out, until the temperature of the fixing roller 40 recovers during the continuous paper delivery, by using the capacitor C of the auxiliary power source 4 to prevent the temperature of the fixing roller 40 from dropping because of lack of power supply during continuous paper delivery, thereby preventing reduction in productivity such as copy speed-down (cpm down) and a halt.

The power supplied by the main power source 3 increases with the start of the image formation, from a no-supply state during standby up to a normal power of 1200 watts (i.e. the upper limit value of the commercial power) (between the time points a and b), reduces to 800 watts due to distribution of the power to other driving units such as the reading unit 11 (between the time points b and c), and then recovers to 900 watts due to termination of the image reading (between the time points c and d). After completion of copying, the charge power to charge the capacitor C is supplied up to a time point e, and then the power supply returns to the standby state.

The output voltage of the capacitor C of the auxiliary power source 4 shows the target voltage of 44 volts that is the maximum value during standby, drops by supplying power to heat the fixing roller 40 during a paper delivery (between the time points b and c), starts to rise by receiving charge after the completion of copying, reaches the target voltage at the time point e, and returns to a standby state.

The controlling unit 8 carries out the above control. At the time point c of termination of document reading, the amount of power supply from the main power source 3 to the fixing device 36 is increased. Therefore, when the discharge time of the capacitor C is set to at least the time taken to read the maximum number of paper (100 sheets of paper in the above example), it is possible to avoid the temperature drop of the fixing roller 40.

Figure 5:
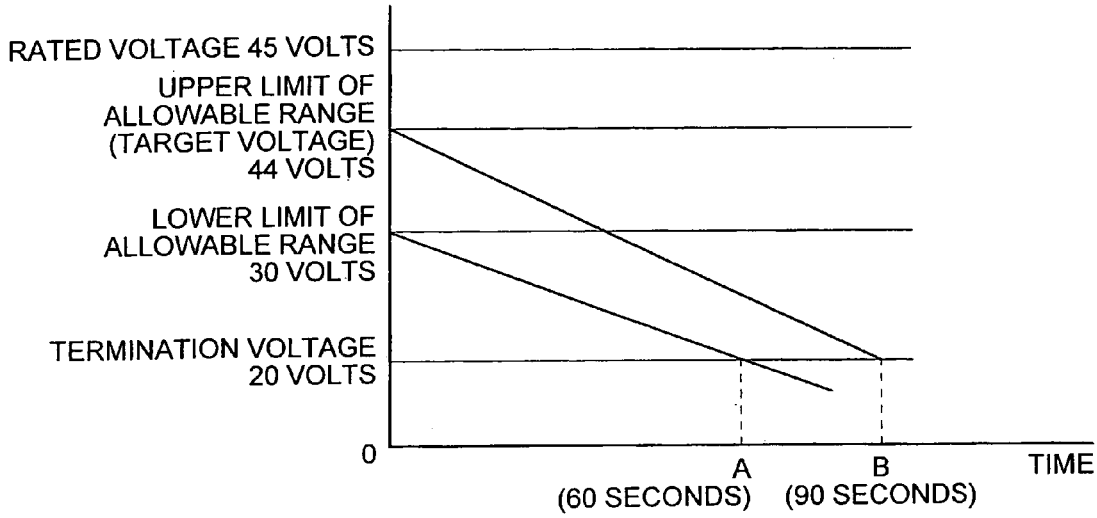
FIG. 5 is a schematic for explaining examples of thresholds.

Thus, as shown in FIG. 5, the upper limit value of the allowable range for starting discharge is set to 44 volts, and the lower limit value of the allowable range for starting discharge is set to 30 volts. In case that the voltage of the capacitor C is 30 volts (the lower limit value) at the time of starting discharge, as shown in FIG. 5, the temperature of the fixing roller 40 is kept at a preset temperature or higher from time 0 to a time A, in other words, until the voltage of the capacitor C reduces to the termination voltage of 20 volts. On the other hand, in case that the voltage of the capacitor C is 44 volts (the upper limit value) at the time of starting discharge, the temperature of the fixing roller 40 is kept from time 0 to a time B. Both time (A and B) are longer than a time necessary for the reading unit 11 to read 100 sheets of documents. According to the example shown in FIG. 4, A is 60 seconds or longer, and B is 80 seconds or longer (for example, 90 seconds). It is possible that only the time B is longer than the time necessary for the reading unit 11 to read the maximum number of documents that can be read at one time.

Further, it is a matter of course that the thresholds described above can be set based on other conditions. For example, instead of the time in which the temperature of the fixing roller 40 can be kept at the preset temperature or higher, the time in which the capacitor C can supply power to the heating unit 2 by discharge until the termination voltage can be set longer than the time necessary for the reading unit 11 to read 100 sheets of documents at one time.

In the present embodiment described above, various controls are carried out by the controlling unit 8 provided to the heating system 1; however the present invention is not limited to the embodiment. The fixing device 36 or the image forming apparatus provided with the fixing device 36 may be provided with a controlling unit and the controlling unit may carry out control. In either case, a structure in which an exclusive controlling unit for discharge voltage control may be provided or the controlling unit may serve as other controlling units is applicable. Accordingly, the structure is not limited to the illustrated example.

Furthermore, in the embodiment explained above, the two rollers, that is, the fixing roller 40 and the pressure roller 41 form the nip portion N; however, the fixing device and the image forming apparatus using the fixing device are not limited to the above structure, and various structures in which the nip portion N is formed by a roller and a belt, a belt and a belt, or the like, a recording medium P passes in slidable contact with or adjacently to a heated element, and so forth can be applied. Still further, the present invention is not limited to the type of the image forming apparatus illustrated. The present invention is applicable to various types of apparatus, for example, in which the photosensitive member is not in a drum shape but in a belt shape, and an intermediate transfer belt is used for a color image forming apparatus and the like. Still further, the fixing device and the image forming apparatus using the fixing device of the present invention may use not only a capacitor but also another condenser such as a secondary battery as an auxiliary power source.

The present invention enables image reading to be reliably terminated at the time of termination of discharge from the condenser, and a reliable fixing action to be secured by making it possible to supply commercial power used for the reading unit to the fixing unit, thereby increasing utilization efficiency of the condenser and reducing cost and size.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

a condenser;

a reading unit that reads images of a plurality of documents one-by-one;

a heating unit that applies heat to an unfixed image that corresponds to the images read by the reading unit; and a power-controlling unit that causes the condenser to initiate power to the heating unit at a beginning of a reading operation when a voltage of the condenser is higher than a threshold and to continue the supply of power until termination of the reading operation, wherein the threshold is determined so that the temperature of the heating unit can be kept at a predetermined temperature or higher for a predetermined time.

2. The image forming apparatus according to claim 1, wherein the power-controlling unit causes the condenser to stop supplying power to the heating unit when the voltage of the condenser is lower than a second threshold, wherein the second threshold is determined so that the temperature of the heating unit can be kept at a predetermined temperature or higher for the predetermined time.

3. The image forming apparatus according to claim 1, wherein the predetermined time is a maximum time for the image reading unit to read as many of the images that can be read at one time.

4. An image forming apparatus comprising:

a condenser;

a reading unit that reads images of a plurality of documents one-by-one;

a heating unit that applies heat to an unfixed image that corresponds to the images read by the reading unit; and a power-controlling unit that causes the condenser to initiate power to the heating unit at a beginning of a reading operation when a voltage of the condenser is higher than a threshold and to continue the supply of power until termination of the reading operation, wherein the threshold is determined so that the condenser can keep supplying power to the heating unit for a predetermined time.

5. The image forming apparatus according to claim 4, wherein the power-controlling unit causes the condenser to stop supplying power to the heating unit when the voltage of the condenser is lower than a second threshold, wherein the second threshold is determined so that the condenser can keep supplying power to the heating unit for the predetermined time.

6. The image forming apparatus according to claim 4, wherein the predetermined time is a maximum time for the image reading unit to read as many of the images that can be read at one time.

7. An image forming apparatus comprising:

a condenser;

a reading unit that reads images of a plurality of documents one-by-one;

a heating unit that applies heat to an unfixed image that corresponds to the images read by the reading unit; and a power-controlling unit that causes the condenser to initiate power to the heating unit at a beginning of a reading operation when a voltage of the condenser is higher than a first threshold, and to continue the supply of power until termination of the reading operation to thereby stop supplying power to the heating unit when the voltage of the condenser is lower than a second threshold, wherein a charge target voltage of the condenser, which is higher than the first threshold, is determined so that the temperature of the heating unit can be kept at a predetermined temperature or higher for a predetermined time.

8. The image forming apparatus according to claim 7, wherein the predetermined time is a maximum time for the image reading unit to read as many of the images that can be read at one time.

9. The image forming apparatus according to claim 7, wherein the first threshold and the second threshold are determined so that the temperature of the heating unit can be kept at a predetermined temperature or higher for a predetermined time.

10. The image forming apparatus according to claim 9, wherein the predetermined time is a maximum time for the image reading unit to read as many of the images that can be read at one time.

11. An image forming apparatus comprising:

a condenser;

a reading unit that reads images of a plurality of documents one-by-one;

a heating unit that applies heat to an unfixed image that corresponds to the images read by the reading unit; and a power-controlling unit that causes the condenser to initiate power to the heating unit at a beginning of a reading operation when a voltage of the condenser is higher than a first threshold, and to continue the supply of power until termination of the reading operation to thereby stop supplying power to the heating unit when the voltage of the condenser is lower than a second threshold, wherein a charge target voltage of the condenser, which is higher than the first threshold, is determined so that the condenser can keep supplying power to the heating unit for a predetermined time.

12. The image forming apparatus according to claim 11, wherein the predetermined time is a maximum time for the image reading unit to read as many of the images that can be read at one time.

13. The image forming apparatus according to claim 11, wherein the first threshold and the second threshold are determined so that the condenser can keep supplying power to the heating unit for a predetermined time.

14. The image forming apparatus according to claim 13, wherein the predetermined time is a maximum time for the image reading unit to read as many of the images that can be read at one time.

* * * * *